US007222903B2

(12) United States Patent
Tardiff

(10) Patent No.: US 7,222,903 B2
(45) Date of Patent: May 29, 2007

(54) SPREADER BAR APPARATUS

(75) Inventor: Marc Tardiff, Lowell, MA (US)

(73) Assignee: USA as Represented by the Secretary of the Army, Washington, DC (US)

( * ) Notice: Subject to any disclaimer, the term of this patent is extended or adjusted under 35 U.S.C. 154(b) by 629 days.

(21) Appl. No.: 10/802,083

(22) Filed: Mar. 10, 2004

(65) Prior Publication Data

US 2005/0199567 A1 Sep. 15, 2005

(51) Int. Cl.
*B66C 1/12* (2006.01)

(52) U.S. Cl. ..... 294/81.21; 294/74

(58) Field of Classification Search ..... 294/81.1, 294/81.2, 81.21, 81.3, 67.4, 74; 452/189–192
See application file for complete search history.

(56) References Cited

U.S. PATENT DOCUMENTS

| | | | | |
|---|---|---|---|---|
| 2,020,174 | A | 11/1935 | Derossi | |
| 3,021,166 | A * | 2/1962 | Kempel et al. | 294/74 |
| 3,502,364 | A * | 3/1970 | Moore | 294/67.1 |
| 3,829,145 | A | 8/1974 | Gottlieb et al. | |
| 4,215,891 | A * | 8/1980 | Thiele | 294/74 |
| 4,248,472 | A * | 2/1981 | Brown et al. | 296/36 |
| 4,397,493 | A | 8/1983 | Khachaturian et al. | |
| 4,462,627 | A * | 7/1984 | Kudlicka | 294/81.21 |
| 4,538,849 | A | 9/1985 | Khachaturian et al. | |
| 4,763,942 | A * | 8/1988 | Lyon | 452/192 |
| 4,842,314 | A | 6/1989 | Bellow | |
| 4,909,555 | A * | 3/1990 | Blasi | 452/189 |
| 5,263,675 | A * | 11/1993 | Roberts et al. | 248/219.4 |
| 5,603,544 | A | 2/1997 | Bishop et al. | |
| 5,716,088 | A | 2/1998 | Chander et al. | |
| 5,863,085 | A | 1/1999 | Khachaturian | |
| 6,079,760 | A | 6/2000 | Khachaturian | |
| 6,296,288 | B1 | 10/2001 | Khachaturian | |
| 6,412,649 | B1 | 7/2002 | Khachaturian | |

* cited by examiner

*Primary Examiner*—Dean J. Kramer
(74) *Attorney, Agent, or Firm*—Vincent J. Ranucci

(57) ABSTRACT

The present invention is directed to a spreader bar. The spreader bar has an elongate central member having a hollow interior, and a pair of elongate end members wherein each elongate end member is partially disposed within the hollow interior of the central elongate member so that a first portion of the elongate end member is within the hollow interior of the elongate central member and a second portion of the elongate end member is external to the hollow interior. The second portion of each elongate end member extends to a distal end. The spreader bar has a pair of sling guides wherein each sling guide is attached to the distal end of a corresponding elongate end member.

19 Claims, 6 Drawing Sheets

SPREADER BAR APPARATUS

STATEMENT OF GOVERNMENT INTEREST

The invention described herein may be manufactured and used by the U.S. Government for Governmental purposes without the payment of any royalties thereon.

BACKGROUND OF THE INVENTION

1. Field of the Invention

The present invention generally relates to a new and improved spreader bar for use in lifting operations.

2. Description of the Related Art

Spreader bars are commonly used in industry for lifting large objects with a single hook that is attached to the lift cables of a helicopter, crane or other lifting device. A lifting hook is commonly provided with a pair of slings that depend from the helicopter or crane hook at angles in a bridle fashion. Each of the slings contacts a respective end portion of the spreader bar and then continues downwardly wherein it is attached to a load that is to be lifted.

One particular problem with spreader bars relates to the size of the spreader bar relative to the particular load that is to be lifted. Some prior art spreader bars have telescoping sections to adjust the spreader bar to different lengths to accommodate different loads. Such telescoping spreader bars have operated well in lifting relatively light loads of a few thousand pounds but have exhibited problems in lifting very heavy loads. Another problem of prior art spreader bars is related to transportation and storage of the spreader bar. Many prior art spreader bars are extremely heavy when compared to the strength of an average worker. Therefore, it is difficult for a single worker to move, lift and transport many of the prior art spreader bars.

The prior art reveals several different spreader bar apparatuses and similar devices. U.S. Pat. Nos. 6,079,760 and 6,296,288 disclose a spreader bar that comprises a plurality of bar sections that are connected end-to-end to form a lifting bar with a central longitudinal axis and with left and right end bar end members. U.S. Pat. No. 6,412,649 discloses a spreader bar that includes an elongated bar member that has end portions which support a flexible lifting member. U.S. Pat. No. 5,863,085 discloses a spreader bar that has a rigid elongated support bar. End caps are connected to the rigid elongated support bar in order to use the spreader bar in a lifting operation. The end caps have sockets that fit over the ends of the bar. U.S. Pat. No. 5,716,088 discloses a lifting frame and a single-piece spreader bar. The end caps have sockets that fit over the ends of the bar. U.S. Pat. No. 5,603,544 discloses compression cap assemblies that are used with the ends of a spreader bar. U.S. Pat. No. 4,842,314 discloses a pipe lift cap assembly comprising a pair of first and second cap members that can be removably attached to respective ends of a pipe or casing. The end caps have sockets that fit over the ends of the bar. U.S. Pat. No. 4,538,849 discloses a spreader bar assembly that has a pair of separate elongated spreader bars. Each spreader bar is supported independently by alternate radially branching lines. U.S. Pat. No. 4,397,493 discloses a spreader bar assembly that utilizes a single rigid member. U.S. Pat. No. 3,829,145 discloses a spreader bar extension that comprises a rectangular upper framework. U.S. Pat. No. 2,020,174 discloses a vehicle hoist frame that comprises two tubular rods that are interconnected at the center by a pivot. Each tubular rod has a plate-disc at the center of the tubular rod. Each disc has a slot in the shape of the arc of a circle.

What is needed is a new and improved spreader bar apparatus that has the required strength for military and commercial applications, but which is compact, light-weight and relatively inexpensive to manufacture.

SUMMARY OF THE INVENTION

The present invention is directed to a spreader bar apparatus. The spreader bar has an elongate central member having a hollow interior, and a pair of elongate end members wherein each elongate end member is partially disposed within the hollow interior of the central elongate member so that a first portion of the elongate end member is within the hollow interior of the elongate central member and a second portion of the elongate end member is external to the hollow interior. The second portion of each elongate end member extends to a distal end. The spreader bar has a pair of sling guides wherein each sling guide is attached to the distal end of a corresponding elongate end member. The first portion of each elongate end member has an end that is located within the hollow interior of the elongate central member. These ends of the first portions of the elongate end members abut one another so as to cause compressive forces to be translated through the entire spreader bar.

DESCRIPTION OF THE PREFERRED EMBODIMENTS

Figure 1:
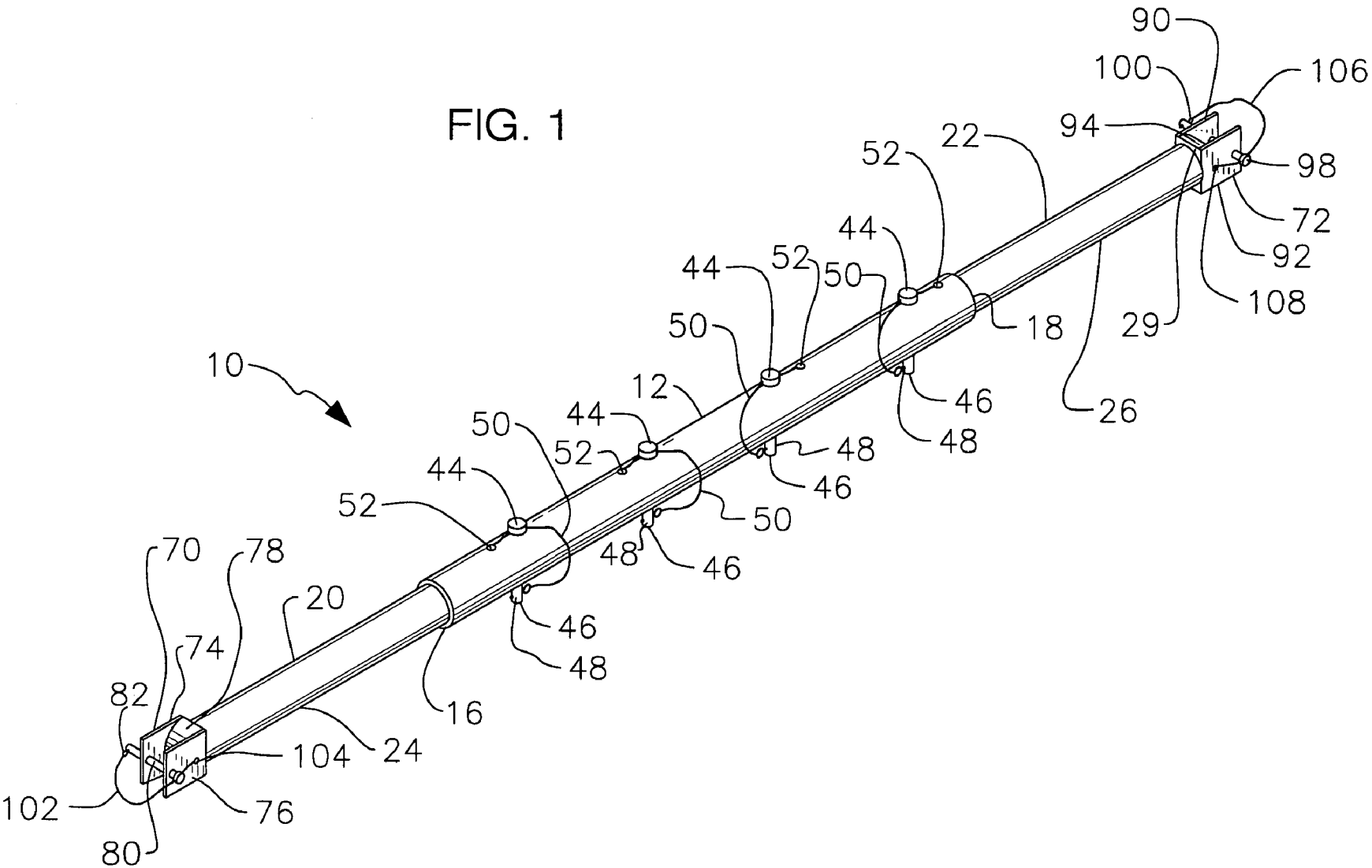
FIG. 1 is perspective view of the spreader bar apparatus of the present invention.

In the description of the invention various embodiments and/or individual features are disclosed. As will be apparent to the ordinarily skilled practitioner, all combinations of such embodiments and features are possible and can result in preferred executions of the invention.

Referring to FIGS. 1, 2, 3, 6 and 7, there is shown spreader bar 10 of the present invention. Spreader bar 10 comprises elongate central member 12 which has hollow interior 14 and opposite distal end portions 16 and 18. Each distal end portion 16 and 18 defines an opening, one of which being opening 18 while the other opening is not shown, in communication with hollow interior 14. Spreader bar 10 further comprises a pair of elongate end members 20 and 22. Elongate end member 20 has portion 23 that is disposed within hollow interior 14 of elongate central member 12 and portion 24 which is external to hollow interior 14 (see FIG. 7). Similarly, elongate end member 22 has portion 25 that is disposed within hollow interior 14 and portion 26 that is external to hollow interior 14. Elongate end member 20 has distal end 27 external to hollow interior 14 and end 28 within hollow interior 14. Similarly, elongate end member 22 has distal end 29 external to hollow interior 14 and end 30 within hollow interior 14. In accordance with the invention, ends 28 and 30 of elongate end members 20 and 22, respectively, abut one another so as to cause compressive forces that are produced by a sling line attached to a load in a lifting operation to be translated throughout the entire spreader bar 10, i.e. elongate end members 20 and 22.

Referring to FIGS. 1-7, in a preferred embodiment, elongate central member 12 and elongate members 20 and 22 are substantially tubular in shape and have a generally circular cross-section. However, it is to be understood that elongate central member 12 and elongate members 20 and 22 can have other suitable cross-sectional shapes, e.g. square, oval, rectangular, triangular, etc.

Figure 3:
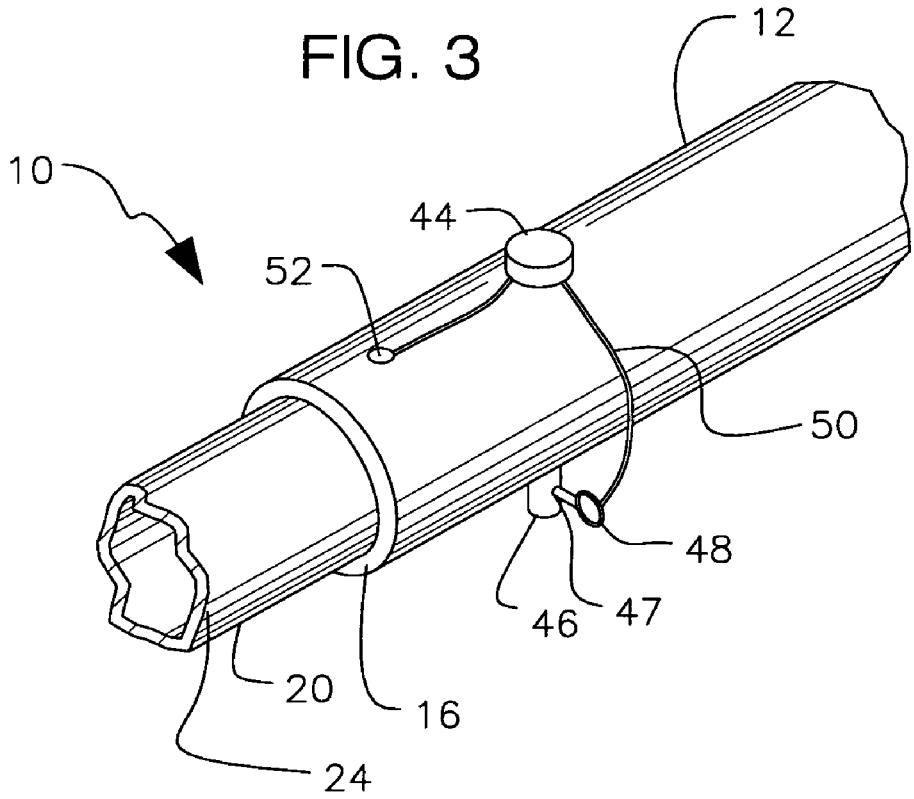
FIG. 3 is an enlarged view of a portion of the view shown in FIG. 1.
Figure 4:
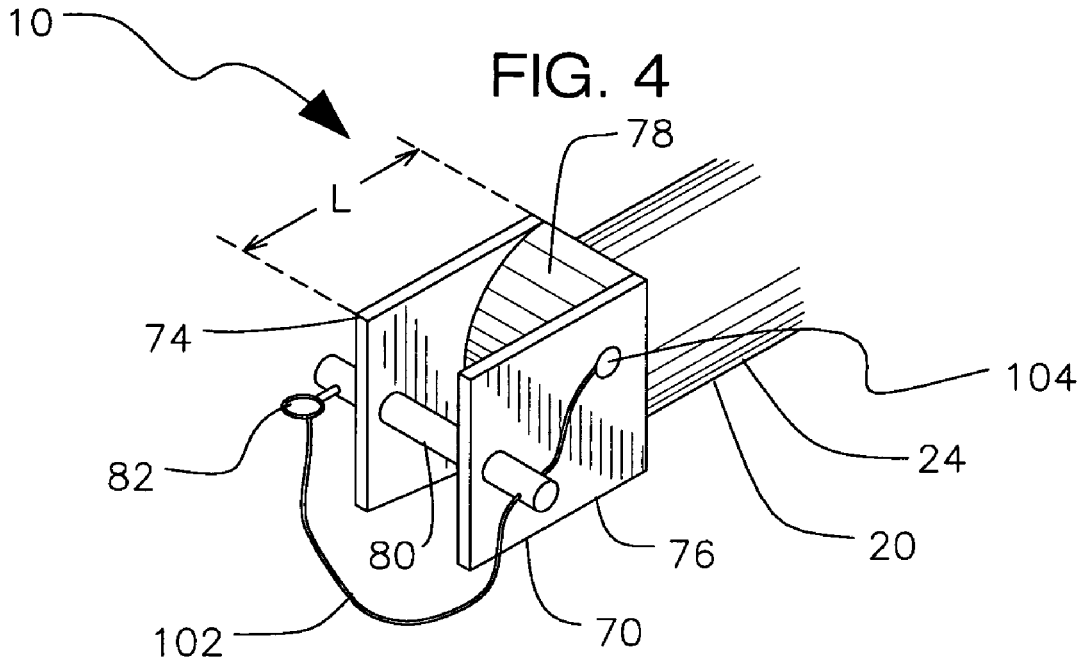
FIG. 4 is an enlarged view of a guide member shown in FIG. 1.
Figure 5:
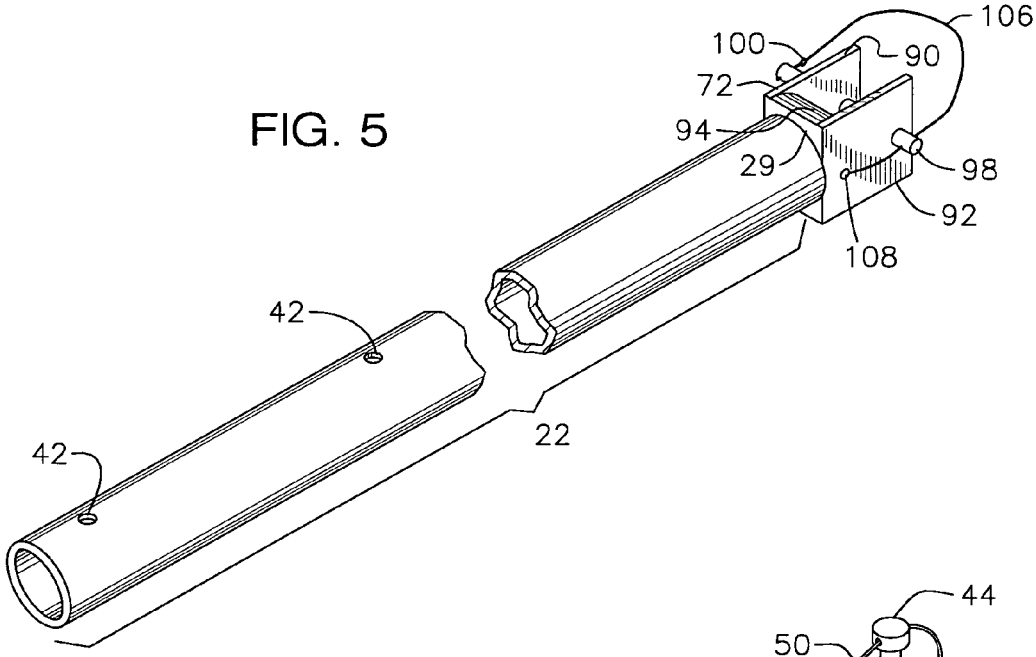
FIG. 5 is partial view, in perspective, of an elongate end member shown in FIG. 1.
Figure 6:
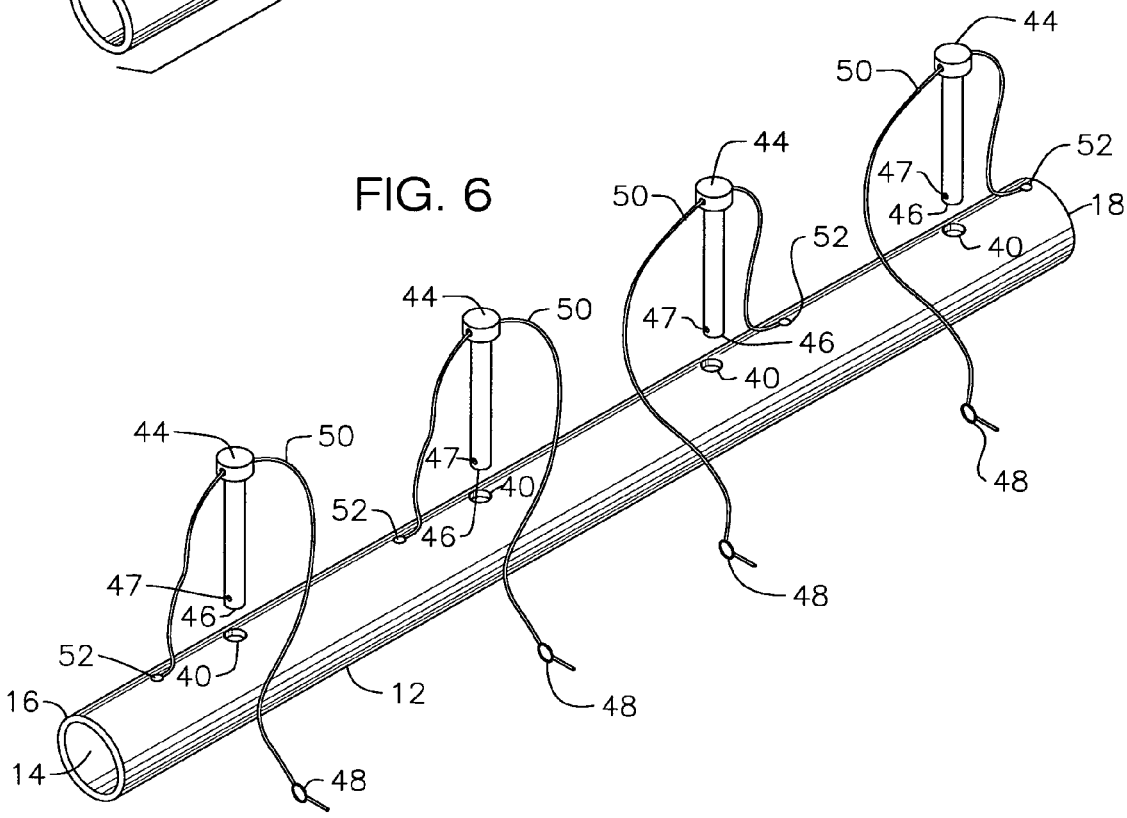
FIG. 6 is perspective view of an elongate central member shown in FIG. 1.
Figure 7:
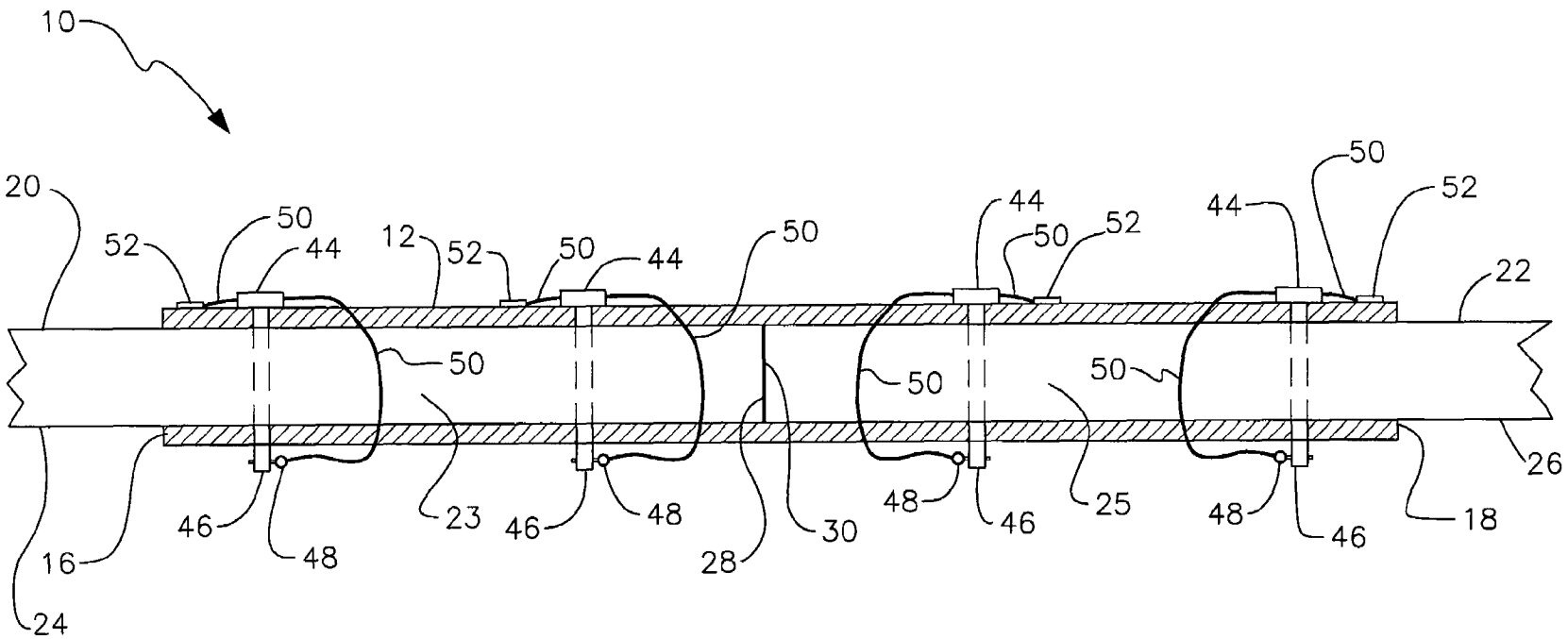
FIG. 7 is a partial view, in cross-section, showing portions of the elongate end members disposed in the hollow interior of the central member.

Referring to FIGS. 3, 5 and 6, spreader bar 10 further comprises a locking system to prevent elongate end members 20 and 22 from being dislodged from hollow interior 14 of elongate central member 12. In one embodiment, the locking system comprises a plurality of pairs of diametrically positioned openings 40 in elongate central member 12, and a plurality of pairs of diametrically positioned openings 42 in each elongate end member 20 and 22. Due to the particular views shown in FIGS. 5 and 6, the openings located in the bottom sides of elongate central member 12 and elongate end members 20 and 22 are not shown. Each pair of diametrically positioned openings 40 in elongate central member 12 are substantially aligned with a corresponding pair of diametrically positioned openings 42 in elongate end members 20 and 22. The locking system further comprises a plurality of pin members 44. Each pin member 44 is removably disposed through a corresponding pair of diametrically positioned openings 40 in elongate central member 12 and a corresponding pair of diametrical positioned openings 42 in either elongate end member 20 or elongate end member 22. Each pin member 44 has distal end 46 that is exposed when pin member 44 is disposed though diametrically positioned openings 40 of the elongate central member 12 and diametrically positioned openings 42 of end members 20 and 22 (see FIGS. 1, 6, 7 and 8). Each pin member 44 has opening 47 adjacent distal end 46. The locking system further comprises a plurality of locking members 48. Each locking member 48 is disposed through an opening 47 of a corresponding pin member 44 so as to prevent each pin member 44 from becoming dislodged from diametrically positioned openings 40 of elongate central member 12 and diametrically positioned openings 42 of elongate end members 20 and 22. In one embodiment, each locking member 48 comprises a cotter pin. The locking system further comprises a plurality of ties 50. Each tie 50 has a first end that is attached to elongate central member 12 with fastener 52. Fastener 52 can be any suitable device such as a rivet, screw, bolt, etc. Another portion of each tie 50 is attached to a corresponding pin member 44. In one embodiment, each tie 50 is threaded through a cavity (not shown) in a corresponding pin member 44. Each tie 50 also has a second end that is attached to a corresponding locking member 48. Tie 50 prevent pin members 44 and locking members 48 from being separated from spreader bar apparatus 10 or otherwise lost or misplaced. In one embodiment, each tie 50 comprises a wire lanyard. The locking system secures elongate end members 20 and 22 within hollow interior 14 of elongate central member 12 and prevents elongate end members 20 and 22 from becoming dislodged from hollow interior 14. In order to remove elongate end members 20 and 22 from hollow interior 14, locking members 48 must first be removed from all openings 47 in pin members 44. Next, pin members 44 are then be withdrawn from diametrically positioned openings 40 and 42. Elongate end members 20 and 22 can then be removed from hollow interior 14 of elongate central member 12.

Referring to FIGS. 1, 2, 4, 5 and 8, spreader bar 10 comprises a pair of sling guide members 70 and 72. Sling guide member 70 is attached to end 27 of elongate end member 20 and sling guide member 72 is attached to end 29 of elongate end member 22. Sling guide member 70 comprises a pair of guide plates 74 and 76 that are arranged in a generally vertical orientation. Sling guide member 70 further comprises generally smooth, rounded and downwardly sloping contact surface 78 that is between guide plates 74 and 76. Contact surface 78 is free of any burrs or surface aberrations that can cause damage to a sling line. During a lifting operation, guide plates 74 and 76 contain the sling line therebetween so that the sling line contacts contact surface 78. Guide plates 74 and 76 have aligned openings (not shown) for receiving pin member 80 which maintains the sling line between guide plates 74 and 76. A locking member 82 is removably disposed within an openings (not shown) in pin member 80 to prevent pin member 80 from being dislodged from the openings (not shown) in guide plates 74 and 76. In one embodiment, locking member 82 comprises a cotter pin.

Similarly, sling guide member 72 comprises a pair of guide plates 90 and 92 that are arranged in a generally vertical orientation. Sling guide member 72 further comprises generally smooth, rounded and downwardly sloping contact surface 94 that is between guide plates 90 and 92. Contact surface 94 is free of any burrs or surface aberrations that can cause damage to a sling line. During a lifting operation, guide plates 90 and 92 contain the sling line therebetween so that the sling line contacts contact surface 94. Guide plates 90 and 92 have aligned openings (not shown) for receiving pin member 98 which maintains a sling line between guide plates 90 and 92. Locking member 100 is attached to pin member 98 to prevent pin members 98 from being dislodged from the openings (not shown) in guide plates 90 and 92. In one embodiment, locking member 100 comprises a cotter pin.

Referring to FIGS. 1, 2, 4, 5 and 8, sling guide member 70 comprises tie 102 which has one end attached to guide plate 76 with fastener 104. Fastener 104 can be any suitable device such as a screw, rivet, bolt, etc. Tie 102 is threaded through a cavity (not shown) in the top portion of pin member 80. In an alternate embodiment, tie 102 is rigidly attached to pin member 80. The other end of tie 102 is attached to locking member 82. Tie 102 prevents pin member 80 and locking member 82 from being separated from spreader bar 10 or otherwise misplaced or lost. In one embodiment, tie 102 comprises a wire lanyard. Similarly, sling guide member 72 comprises tie 106 which has one end attached to guide plate 92 with fastener 108. Fastener 108 can be any suitable device such as a screw, rivet, bolt, etc. Tie 106 is threaded through a cavity (not shown) in the top portion of pin member 98. In an alternate embodiment, tie 106 is rigidly attached to pin member 98. The other end of tie 106 is attached to locking member 100. Tie 106 prevents pin member 98 and locking member 100 from being separated from spreader bar apparatus 10 or otherwise misplaced. In one embodiment, tie 104 comprises a wire lanyard.

Figure 2:
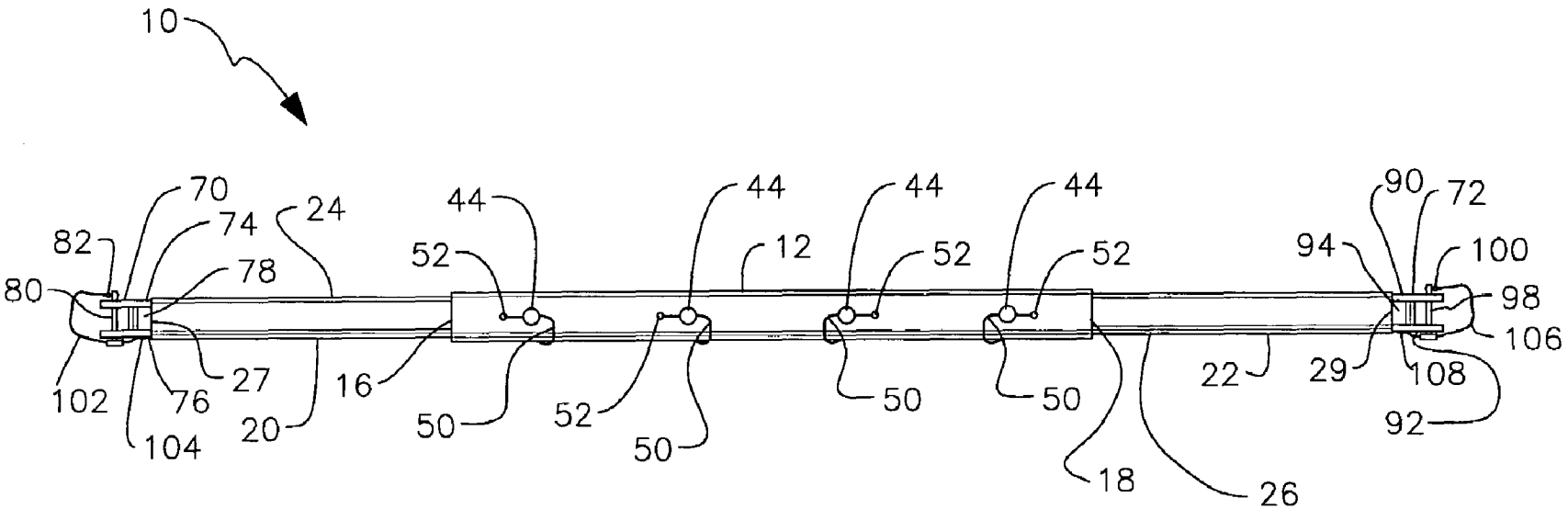
FIG. 2 is a top view of the spreader bar apparatus of FIG. 1.

Referring to FIGS. 1 and 2, spreader bar 10 can be made out of a variety of materials, e.g. steel, aluminum, composite materials. In a preferred embodiment, spreader bar 10 is fabricated from metal. More preferably, spreader bar 10 is fabricated from aluminum. If spreader bar 10 is fabricated from steel, it is preferable that a non-corrosive coating be applied to the steel.

Figure 8:
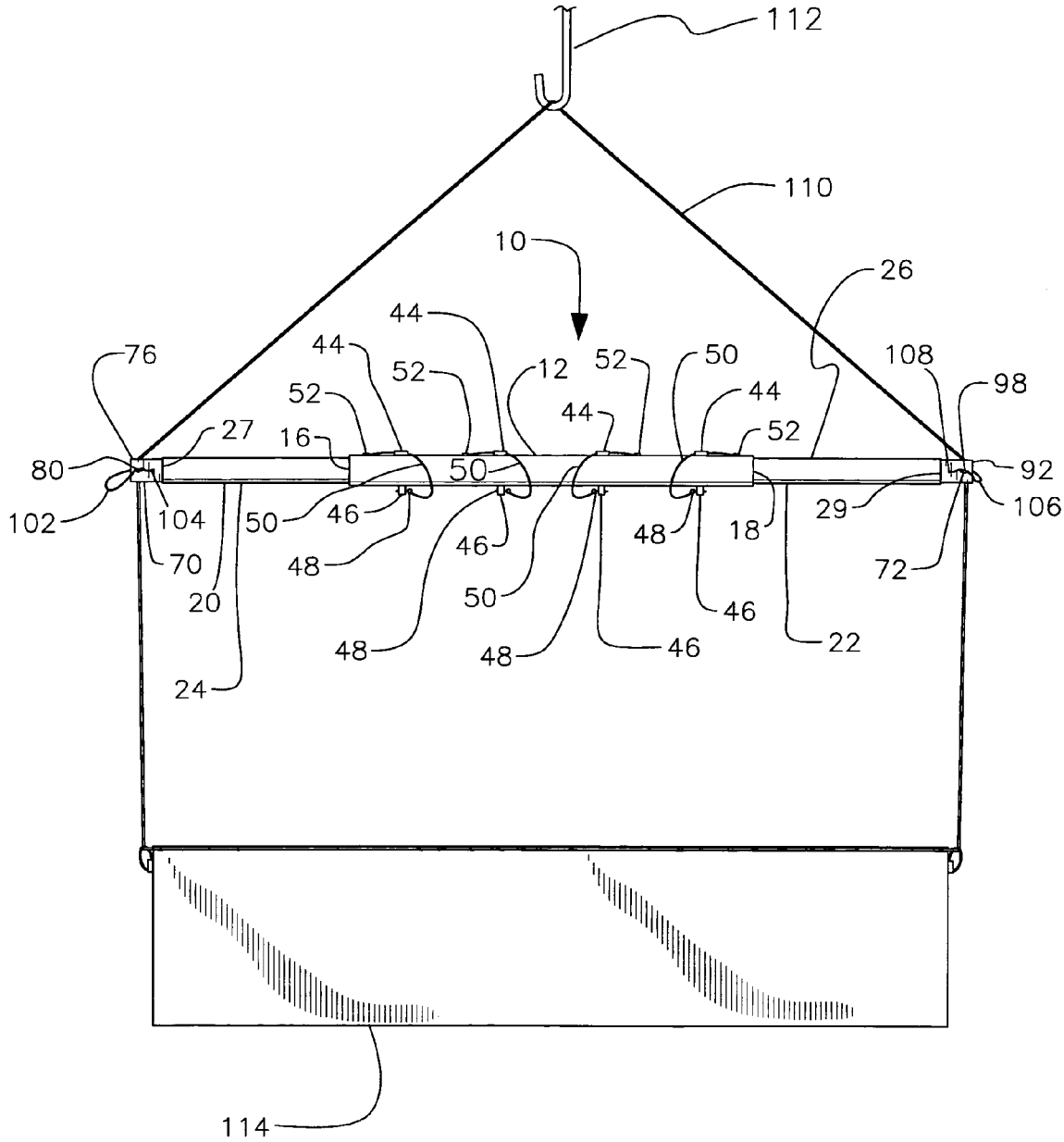
FIG. 8 is side-elevational view showing the spreader bar apparatus of the present invention being used in a lifting operation.

Referring to FIG. 8, there is shown spreader bar 10 during a lifting operation. Sling line 110 is carried by hook 112 that is attached to a lift line (not shown) which is suspended by a lifting machine such as a crane or helicopter (not shown). Sling line 110 is attached to load 114 by any suitable means and is positioned between the guide plates of each sling guide member 70 and 72 as described in the foregoing description. The compressive force exerted by sling line 110 on spreader bar 10 is translated throughout the entire spreader bar 10.

EXAMPLE

A spreader bar was constructed in accordance with the present invention. The spreader bar 10 was constructed so that elongate central member 12 had a length of 50 inches and the overall length of the spreader bar 10 was 100 inches. Elongate central member 12 had an inner radius of 1½ inches and an outer radius of 1 11/16 inches. Each elongate end member 20 and 22 had an inner radius of 1¼ inches and an outer radius of 1 7/16 inches. The guide plates of each sling guide member 70 and 72 were spaced apart by 2 inches. Each guide plate 74, 76, 90 and 92 had a length L (see FIG. 4) of 4 inches. The total weight of spreader bar was 26 lbs. During testing, a compressive load of 28,000 lbs. was applied to the spreader bar. The spreader bar performed satisfactorily without deformation, bending or damage.

Although the preceding example describes specific dimensions, it is to be understood that such dimensions apply to one particular embodiment of the invention and that other suitable dimensions can be used as well. Furthermore, the preceding example describes a compressive force of 28,000 lbs. that was applied to the spreader bar. However, it is to be understood that the spreader bar of the present invention can be used in situations wherein the compressive force exceeds 28,000 lbs.

Spreader bar apparatus 10 provides several advantages and benefits. For example, since ends 28 and 30 of elongate end members 20 and 22, respectively, are in an abutting relationship within hollow interior 14 (see FIG. 7), compressive forces caused by sling lines attached to a load are translated throughout the entire spreader bar 10. Thus, spreader bar 10 does not rely on the shear strength of bolts and pins, but rather, relies on the strength of the entire spreader bar thereby increasing the capabilities of spreader bar 10. Furthermore, spreader bar 10 is relatively lighter in weight than most conventional or prior art spreader bars thereby providing ease of use, transportation and storage. Additionally, sling guide members 70 and 72 allow spreader bar 10 to be used for multiple purposes. Spreader bar 10 can be used on crane lifts as well as helicopter lifts. Spreader bar 10 is relatively less expensive to manufacture in comparison to most conventional or prior art spreader bars. Another important advantage of spreader bar 10 is that it can be easily disassembled for purposes of transportation and/or storage. A user can simply remove locking pins 48 from pin members 44, remove pin members 44 from openings 40 and 42, and then remove elongate end members 20 and 22 from the hollow interior 14 of elongate central member 12.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. A spreader bar apparatus comprising:

an elongate central member having a hollow interior;

a pair of elongate end members, each elongate end member being partially disposed within the hollow interior so that a first portion of the elongate end member is disposed within the hollow interior and a second portion of the elongate end member is external to the hollow interior, the second portion of each elongate end member extending to a distal end; and a pair of sling guide members, each sling guide member being attached to the distal end of a corresponding elongate end member, wherein each sling guide member comprises a pair of guide plates arranged in a generally vertical orientation so as to contain a sling line therebetween; and a generally smooth and downwardly sloping surface between the guide plates for contacting the sling line during a lifting operation.

2. The spreader bar apparatus according to claim 1 wherein the first portion of each elongate end member has an end that is located within the hollow interior and wherein the ends of the elongate end members located in the hollow interior abut one another so as to cause compressive forces to be translated throughout the spreader bar apparatus.

3. The spreader bar apparatus according to claim 1 wherein the elongate central member and is substantially tubular.

4. The spreader bar apparatus according to claim 3 wherein each elongate end member is substantially tubular.

5. The spreader bar apparatus according to claim 1 wherein the elongate end members are removably secured with the hollow interior of the elongate central member.

6. The spreader bar apparatus according to claim 1 further comprising a locking system to prevent the elongate end members from being dislodged from the hollow intenor.

7. The spreader bar apparatus according to claim 6 further wherein the locking system comprises:

a plurality of pairs of diametrically positioned openings in the elongate central member;

a plurality of pairs of diametrically positioned openings in each elongate end member, each pair of diametrically positioned openings in each elongate end member being substantially aligned with a corresponding pair of diametrically positioned openings in the elongate central member; and a plurality of pin members, each pin members being disposed through a corresponding pair of diametrically positioned openings in the elongate central member and a corresponding pair of diametrical positioned openings in one of the elongate end members.

8. The spreader bar apparatus according to claim 7 where in each pin member has a distal end that is exposed when the pin member is disposed through the diametrically positioned openings of the elongate central member and elongate end members, the locking system further comprises a locking member that is fastened to the exposed distal end of each plurality of pin members to prevent each pin member from becoming dislodged from the diametrically positioned openings of the elongate central member and elongate end members.

9. The spreader bar apparatus according to claim 8 wherein the locking system further comprises a tie that has one portion attached to the elongate central member, another portion attached to a corresponding pin member, and a another portion attached to a corresponding locking member.

10. The spreader bar apparatus according to claim 1 wherein each sling guide member further comprises a pin member secured to the guide plates to maintain a sling line between the guide plates.

11. The spreader bar apparatus according to claim 10 wherein each sling guide member further comprises a locking pin member secured to the pin member to prevent the pin member from being dislodged from the guide plates.

12. The spreader bar apparatus according to claim 11 wherein each sling guide member further comprises a tie attached to the pin member, the locking member and one of the guide plates to prevent the pin member and the locking member from being separated from the spreader bar apparatus.

13. The spreader bar apparatus according to claim 1 wherein the elongate central member and the elongate end members are fabricated from metal.

14. The spreader bar apparatus according to claim 13 wherein the elongate central member and the elongate end members are fabricated from aluminum.

15. The spreader bar apparatus according to claim 13 wherein the elongate central member and the elongate end members are fabricated from steel.

16. The spreader bar apparatus according to claim 15 further including a non-corrosive coating on the steel.

17. The spreader bar apparatus according to claim 1 wherein the elongate central member and the elongate end members are fabricated from composite materials.

18. A spreader bar apparatus comprising:

an substantially tubular elongate central member having a hollow interior;

a pair of tubular elongate end members, each elongate end member being partially and removably disposed within the hollow interior so that a first portion of the elongate end member is disposed within the hollow interior and a second portion of the elongate end member is external to the hollow interior, the second portion of each elongate end member extends to a distal end; and a pair of sling guides, each sling guide being attached to the distal end of a corresponding elongate end member; and wherein the first portion of each elongate end member has an end that is located within the hollow interior of the elongate central member and wherein the ends of the elongate end member located in the hollow interior abut one another to cause a compressive force applied to the sling guides to be translated throughout the elongate central member and the elongate end members; and wherein each sling guide comprises a pair of guide plates arranged in a generally vertical orientation so as to contain a sling line therebetween; and a generally smooth and downwardly sloping surface between the guide plates for contacting the sling line during a lifting operation.

19. The spreader bar apparatus according to claim 18 further comprising means for securing the elongate end members to the elongate central member.

* * * * *